US008474620B2

(12) United States Patent
Mather

(10) Patent No.: US 8,474,620 B2
(45) Date of Patent: Jul. 2, 2013

(54) CONTAINER DISPLAY WITH COVER MOUNTINGS

(75) Inventor: Nicole Mather, Laguna Beach, CA (US)

(73) Assignee: Sillage, LLC, Corona del Mar, CA (US)

( * ) Notice: Subject to any disclaimer, the term of this patent is extended or adjusted under 35 U.S.C. 154(b) by 0 days.

(21) Appl. No.: 13/106,580

(22) Filed: May 12, 2011

(65) Prior Publication Data

US 2012/0285856 A1 Nov. 15, 2012

(51) Int. Cl.
*B65D 73/00* (2006.01)

(52) U.S. Cl.
USPC ..... 206/457; 206/456; 206/490; 206/551; 220/376; 220/252; 220/737; 220/738; 220/739; 220/740; 220/741; 220/742; 220/213; 220/23.86; 312/284

(58) Field of Classification Search
USPC ... 206/457, 456, 490, 551; 312/284; 220/376, 220/252, 737–742, 213, 23.86
See application file for complete search history.

(56) References Cited

U.S. PATENT DOCUMENTS

| | | | | | |
|---|---|---|---|---|---|
| 1,452,558 | A | * | 4/1923 | Jackson | 220/326 |
| 1,603,330 | A | * | 10/1926 | Dister | 220/796 |
| 2,704,903 | A | * | 3/1955 | Laughlin | 312/204 |
| 3,995,762 | A | * | 12/1976 | Pfefferkorn et al. | 215/256 |
| 4,375,862 | A | * | 3/1983 | Kurinsky et al. | 220/293 |
| D292,159 | S | * | 10/1987 | Thrush | D7/392.1 |
| 4,741,452 | A | * | 5/1988 | Holzkopf | 220/783 |
| 6,012,203 | A | * | 1/2000 | Baron Pearson | 24/114.9 |

* cited by examiner

*Primary Examiner* — J. Gregory Pickett
*Assistant Examiner* — James M Van Buskirk
(74) *Attorney, Agent, or Firm* — Baker Hostetler LLP; Mark H. Krietzman; P. Alan Larson

(57) ABSTRACT

A cover display for a container in some implementations having a dome shaped cover base with a flat bottom and a top with a radius of curvature with one or more frame catches positioned near the periphery of the cover base. An adorned Tiara shaped cover with an annular wall supporting frame latches positioned to correspond to said frame catches is affixed over said dome shaped cover base.

21 Claims, 12 Drawing Sheets

CONTAINER DISPLAY WITH COVER MOUNTINGS

BACKGROUND

1. Field

This disclosure relates to an adorned display cover and base.

2. General Background

There is a continuing need to decorate containers to make them more appealing. This is particularly so when the container is vying for attention among a field of other containers. In addition to construct separate covers for containers which share some common features is expensive.

SUMMARY

A container cover is disclosed with visual adornments added to improve visibility to consumers. In some aspects the adornments are three dimensional and provide an additional gripping surface to rotate a large diameter dome cover. In some aspects the adornments are collectables and create a motive for the consumer to acquire the container.

In some instances the adornments or a portions thereof may be removable from said cover. In some instances the adornments or a portions thereof may be attachable and removable from said cover. In some instances the adornments or a portions thereof may form a charm, tiara, pin, jewelry, clip, bracelet or other accessory.

In some exemplary implementations adornments or a portion of adornment(s) are interchangeable with a common mounting system whereby a base cover may support different adornments or provide for the mix and match or swapping of adornments onto said base cover.

A display device including a covered base; said base being a generally dome shaped base with a radius of curvature and one or more indents or protrusions positioned near the periphery of said base; a cover with an annular wall; one or more indents or protrusions at said annular wall which correspond to the location of said corresponding protrusions or indents on said base. In some instances the display device includes a frame and said indents or protrusions extended inward from an annular wall of said frame. In some instances the cover and base are friction fitted via said indents and protrusions.

An generally dome shaped base with a generally flat bottom and a top with a radius of curvature; one or more frame catches positioned near the periphery of said shaped base; a cover with an annular wall; one or more frame latches positioned on said annular wall which correspond to said frame catches; at least on alignment guide means near the periphery of said base; and, at least one alignment key means on the annular wall of said cover. In some instances adornments are added to at least one of said cover and said base. In some instances the base and cover are joined by said latches and catches.

A display device with a base with a generally flat bottom and a hemispherical top; one or more indents or protrusions positioned near the periphery of said base; one or more catches positioned near the periphery of said base; a three dimensional design cover with an annular wall; one or more latches positioned on said annular wall which correspond to said catches; one or more indents or protrusions at said annular wall which correspond to the location of said corresponding protrusions or indents on said base.

As shall be appreciated by those having ordinary skill in the art, the figures are not to scale, and modifications to scale within a figure or across the figures are considered within the present disclosure.

DRAWINGS

The above-mentioned features of the present disclosure will become more apparent with reference to the following description taken in conjunction with the accompanying drawings wherein like reference numerals denote like elements and in which.

Figure 1:
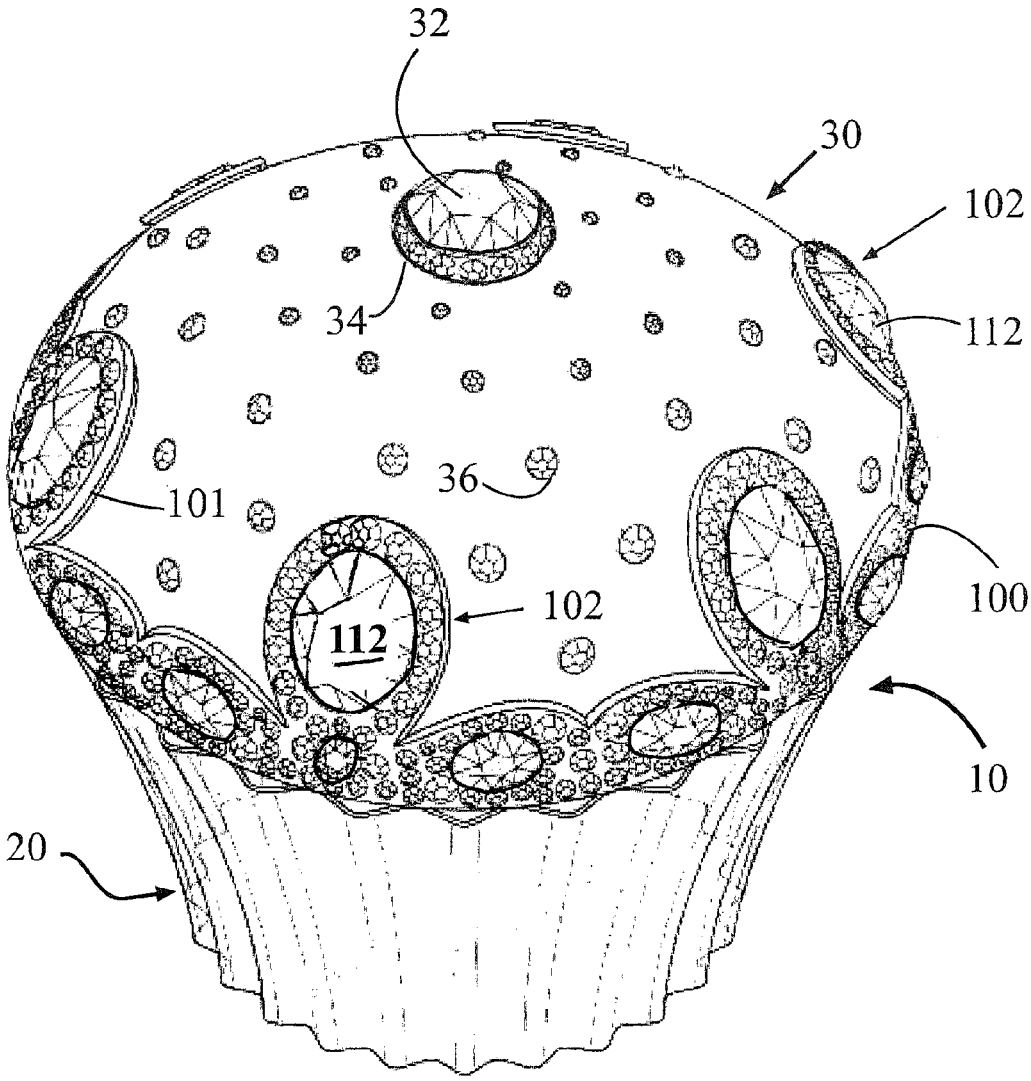
FIG. 1 shows a perspective view of an exemplary implementation of a container and adorned cover of the disclosure.
Figure 2:
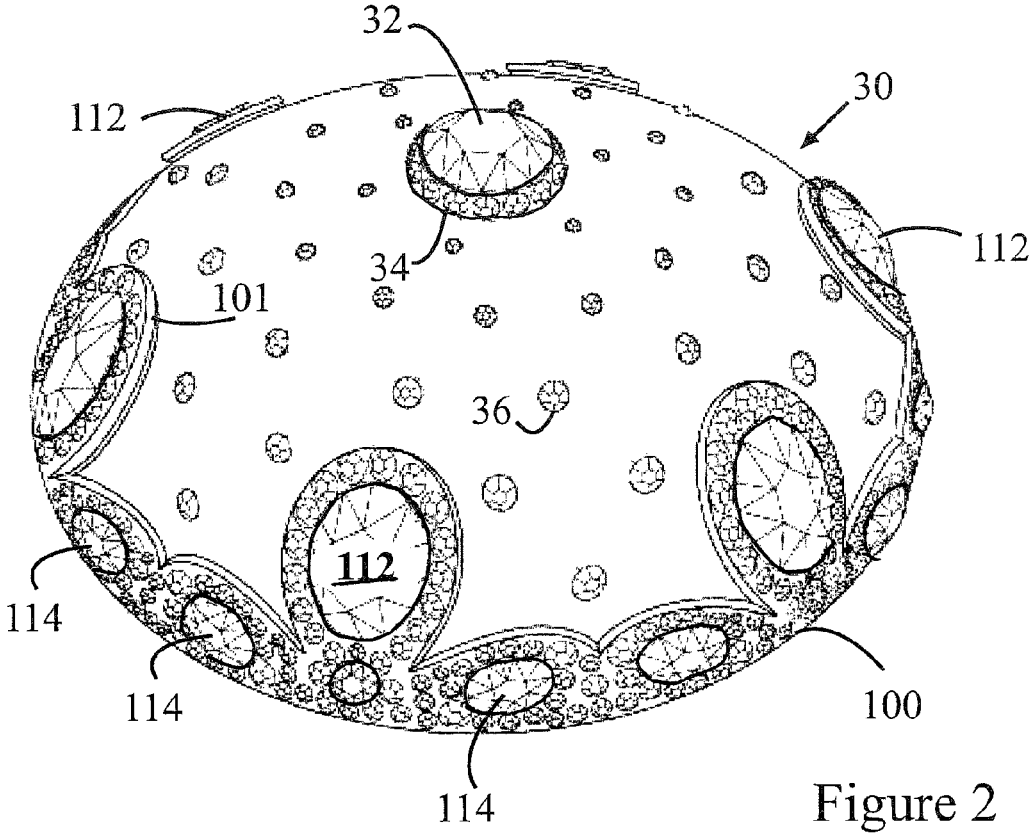
FIG. 2 shows a perspective view of the cover of FIG. 1.
Figure 3:
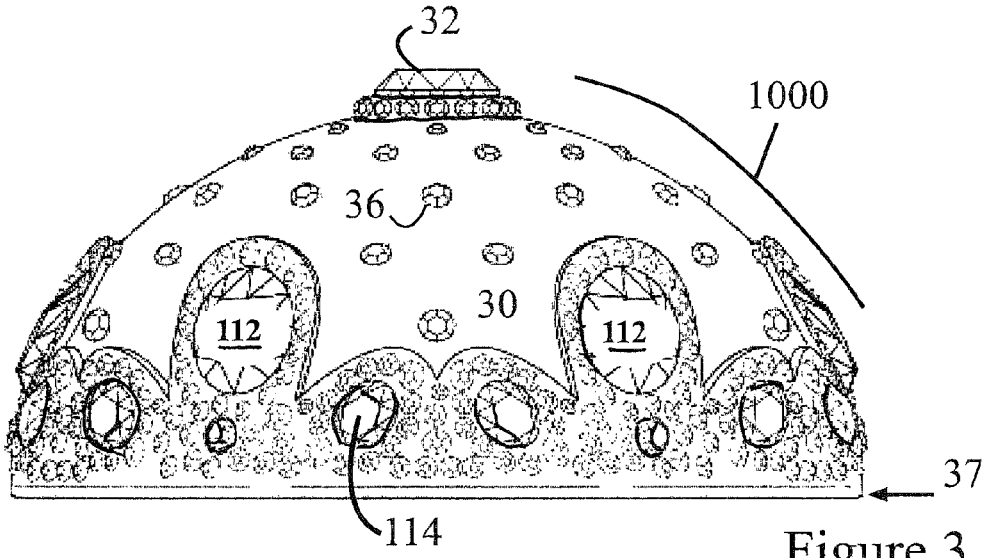
FIG. 3 shows a side view of the cover of FIG. 1.

While the specification concludes with claims defining the features of the present disclosure that are regarded as novel, it is believed that the present disclosure's teachings will be better understood from a consideration of the following description in conjunction with the appendices, figures, in which like reference numerals are carried forward. All descriptions and callouts in the Figures are hereby incorporated by this reference as if fully set forth herein.

FURTHER DESCRIPTION

According to one or more exemplary implementations, as shown in aspects of FIGS. 1-5 a container 10 bottle 20 and cover base 30. Specific individual three dimensional elements (I3DE) 32 may be added to the cover in a fashion which is meant to be permanent. Affixation may include adhesive, heat weld, sonic weld, locks, latch and catch and retaining ring 34 to hold the I3DE to the cover. Smaller adornment elements (SAE) 36 are also shown affixed to the cover base 30. In some instances the composition of I3DE and SAE may include but are not limited to glass, plastic, synthetic, Swarovski®, crystals, natural precious stones, irradiated stones, semi-precious stones, metals, and resins. The cover base has a generally flat bottom edge 37 and a generally hemispherical top with a curvature 1000.

Figure 4:
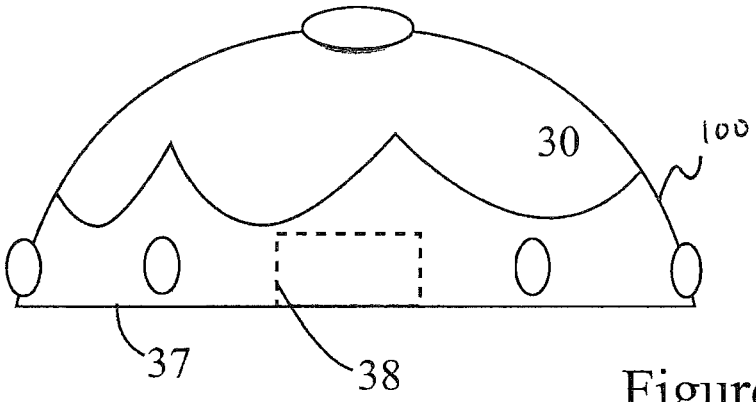
FIGS. 4 and 5 show cut side views of exemplary implementations of cover bases.
Figure 5:
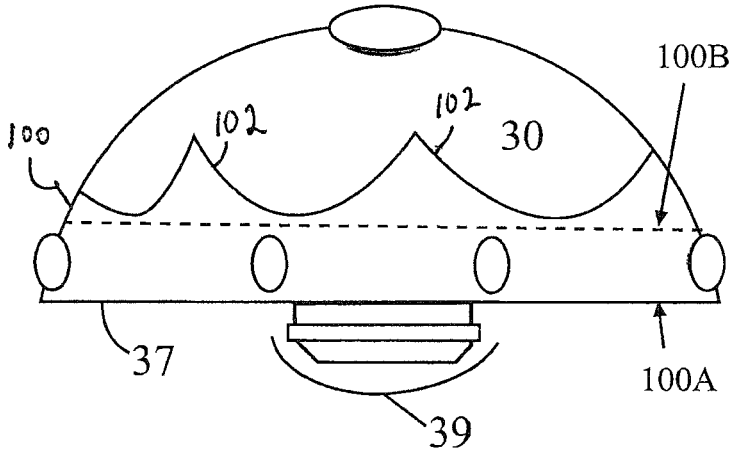

FIGS. 4 and 5 show side views of silhouettes of a cover base 30. The cover base in one instances has a central cavity 38 which holds, houses, mates with, and/or fits over a top portion if a bottle or an attachments (such as a sprayer) of a bottle. In one instance the cover base 30 has an extended neck 39 which corresponds to an opening in a bottle.

Figure 8A:
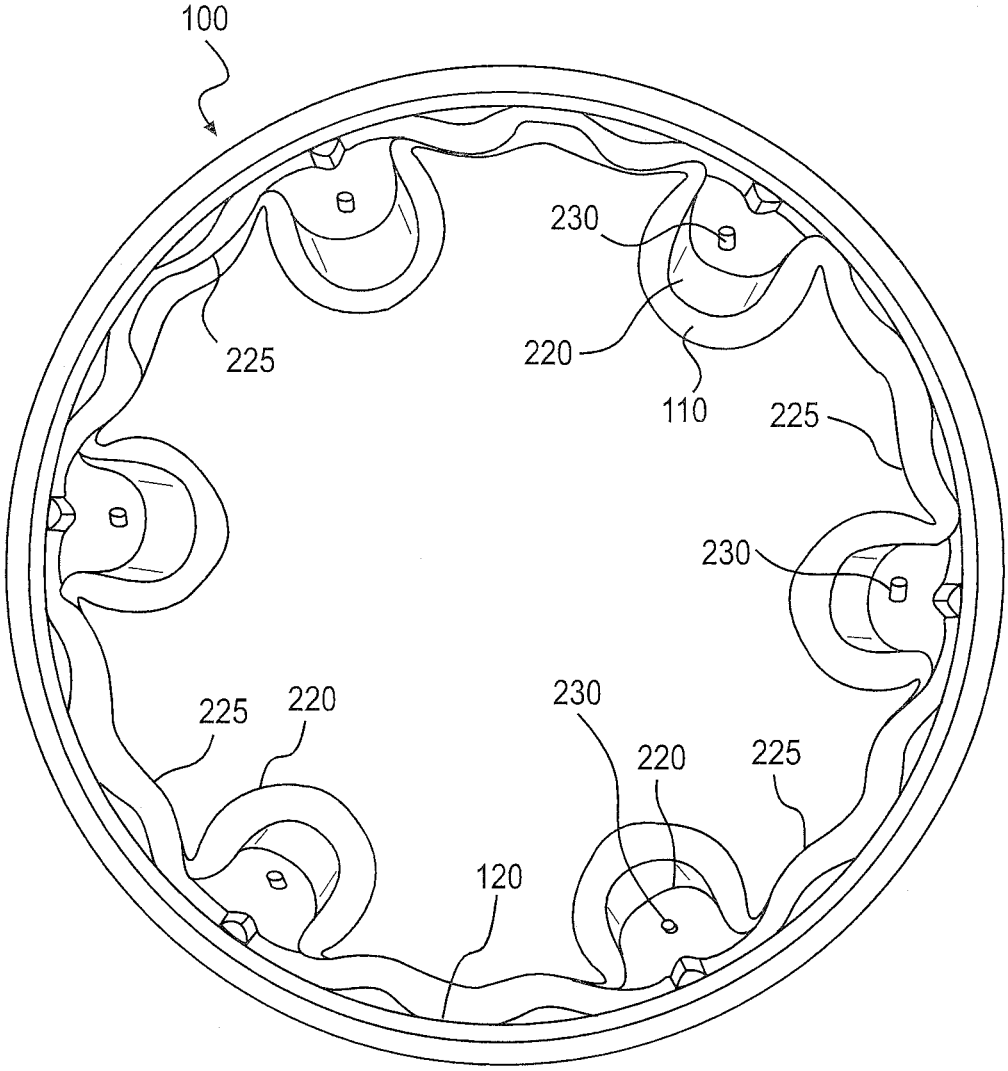
FIG. 8A shows a bottom view of a three dimensional element to fit over a cover base.
Figure 8B:
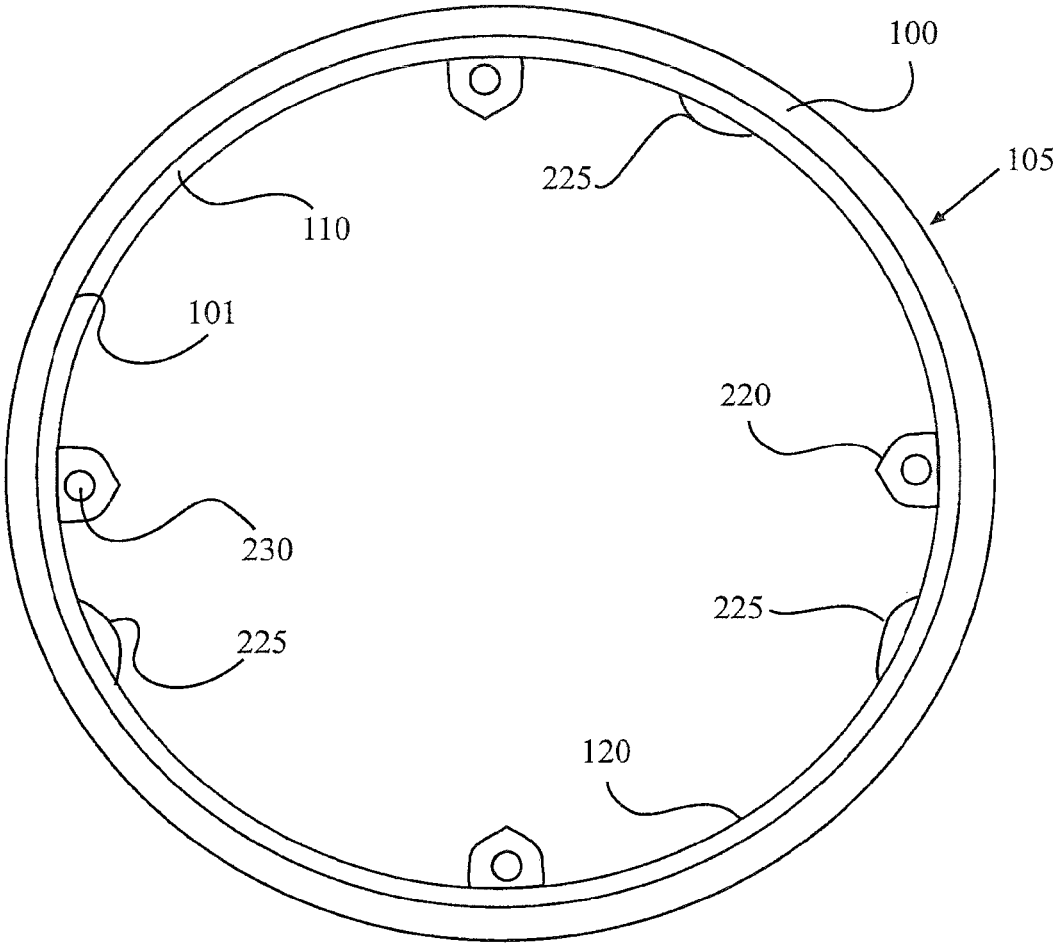
FIG. 8B shows an alternate bottom view of a three dimensional element to fit over a cover base.

A three dimensional element such as an over cover, tiara, band, ring, medallion, or crown cover 100 is shown fitted around the cover base 30. The cover crown may be unitary or it may include a crown frame 110 formed as part of, or attached to, the inner annular wall 101 of said crown cover 100 having a bottom edge 100A and a top edge 100B. From said crown cover are shown projections 102 extending upward from said top edge 100B. Said crown cover, when a unitary structure, or said crown frame when provided, generally circumnavigate the larger diameter portion of the cover base 30 and to generally fit around said cover base. Shown in FIG. 8B is a combined crown cover with crown frame 105. Said crown frame has an inner annular wall 120 of a size and shape to mate with said cover base.

From said crown cover are shown projections 102 extending upward from one of said crown cover and said crown frame. In some instances to present an attractive outer appearance said projections will smoothly extend from the top edge 100B of said crown cover in other instances projections may extend from said crown frame and in yet other instances one or more of said projections may extend from said crown cover and one or more may extend from said crown frame. Said projections or legs provide a structure to affix adornments to. In some exemplary implementations large group three dimensional elements (LG3DE) 112 are affixed to the outer surface of the crown cover 100 and/or projections therefrom. In some exemplary implementations at least one adornment element selected from the group consisting of LG3DE 112, medium group three dimensional elements (MG3DE) 114, I3DE 32 and SAE 36 are affixed to said crown cover. The three dimensional elements provide multiple functions including but not limited to gripping surfaces and visual cues. Said LG3DE and MG3DE may include but are not limited to glass, plastic, crystals, synthetic, Swarovski®, natural precious stones, irradiated stones, semi-precious stones, metals, and resins. Although the cover base is shown in the figures as generally dome shaped, those of ordinary skill in the art will recognize that the disclosure encompasses more rounded or conical shapes which are in addition to the hemispherical top shown in the figures.

Figure 6:
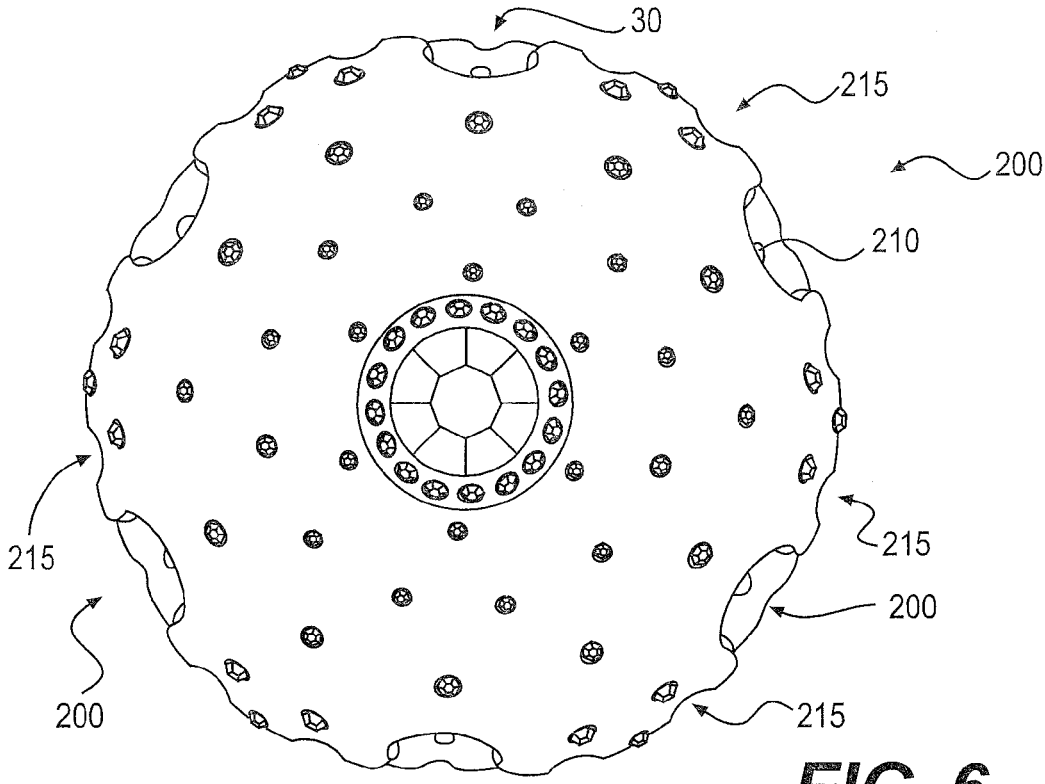
FIG. 6 shows an exemplary implementation of a cover base onto which an adornment may be attached.

FIG. 6 shows a generally dome shaped cover base 30 with the crown cover removed. In some implementations the cover base provides a series of frame catches 200 around the periphery (the larger diameter area) of the cover base. Frame catches are indentations below the radius of curvature of at least a portion of the cover base 30. The catches provide a large surface area to mate with matching latches on the inner side of a cover. Optional pin guides 210 are shown within each frame catch. As shown in FIGS. 8A and 8B, pins 230 are indicated that can mate in said pin guides formed on the inner side of the annular wall 101 of the crown cover 100 or the inner side of the frame annular wall 120 of a crown frame 110. An optional series of indents 215 are also shown. Such indents may be used to provide further resistance to unintended removal of said crown cover 100 during twisting or rotation of a base. In some instances such indentations form an alignment guide means whereby said crown cover 100 may be oriented in a particular position via alignment keys. In some instances crown cover is affixed to the dome shaped cover via at least said latches and catches. In some instances the placement of latches and catches may be reversed on said crown cover and said base.

Figure 7:
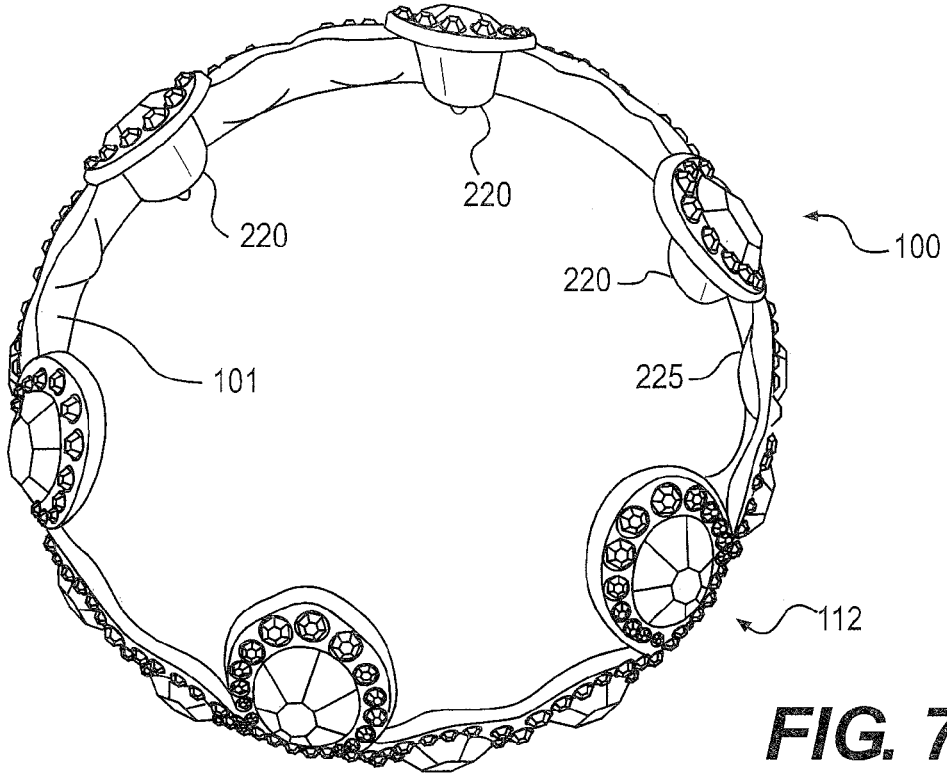
FIG. 7 shows an exemplary implementation of a top view of a three dimensional element to fit over a cover base.

FIGS. 7, 8A and 8B show latches 220 formed on the inner side of the annular wall of the crown cover (or the crown frame) and protrusions 225 which fit against crown base indents 215.

In some instance the placement of indent and protrusions may be reversed and said indentations may also be formed at the annular wall of said crown frame or said crown cover. and said protrusions may be formed on or attached to said crown base. In yet other instances each of indents and protrusions may be formed on both of said crown cover (or crown frame) and said cover base. In some instances a compliant material (not shown) such as resin, film, soft enamel, plastic, rubber, fabric and the like is attached to at least a portion of the annular wall of either the crown frame or crown cover at the interface with the cover base. Said compliant material may be selected to provide at least one of a desired coefficient of friction. a cushion, a barrier against scratching the cover base.

Pins 230 which can fit and/or lock into pin guides 210 formed on or extended from one or more catches. Adhesives, sonic welds, welds, friction fit and the like are all methods and devices to affix said crown cover to the cover base 30. Protrusions mate with indents and in concert inhibit movement or rotation of the crown cover around the crown base. Said protrusions may be friction fit or adhesively fit within said indents 215. It should be noted that the use of the latches and catches is optional. In some instances a protrusion 225 may be used to form an alignment key (rather than cooperate in attachment) providing a means to cooperate with alignment guides (an indent) to obtain a selected positioning of the crown cover on the cover base. In other instances said protrusions (as described above) are cooperative in fitting said crown cover onto said cover base. In some instance wherein said crown cover 100 may have no catches and said cover base 30 may have no latches. Rather, the crown cover 100 may be held against the cover base 30 via the protrusions 225 (or if reversed, said indents) at said annular wall and with the indents 215 (or if reversed protrusions) around the periphery of the cover base until such time as said cover crown 100 is removed.

The illustration of a series of six latches in FIGS. 7, 8A and 8B are shown corresponding to six catches of the cover base 30 not a limitation. As previously noted said latches and catches may be optional wherein the cover crown 100 acts as a display base to support a removable adornment (the crown cover 100 in this implementation). Further, those of ordinary skill in the art will recognize that the number of latches and catches and the addition or deletion of guide pins are design variations which are within the scope of the disclosure.

Figure 9:
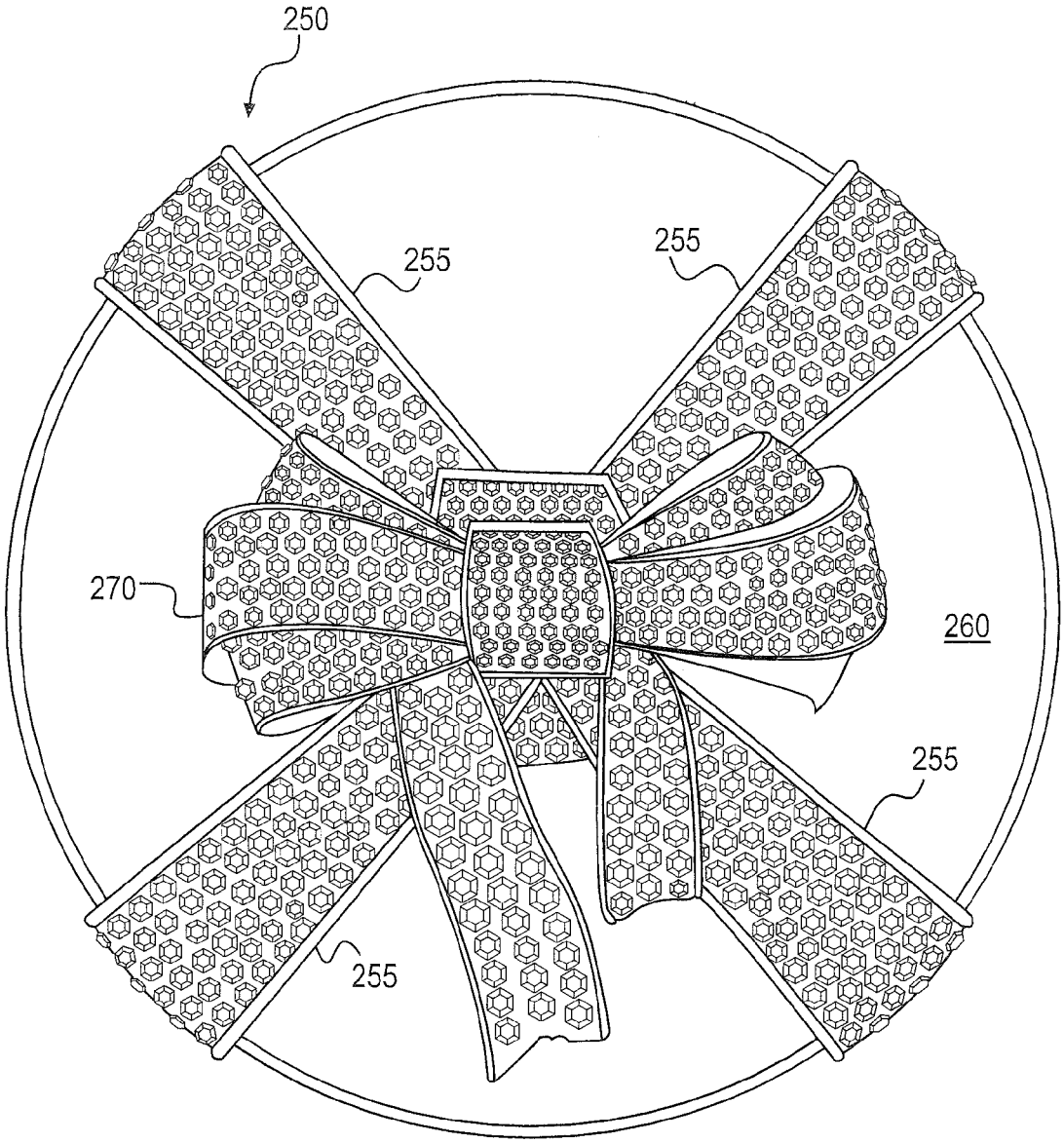
FIG. 9 shows a top view of an exemplary implementation of a three dimensional element to fit over a cover base.

FIG. 9 shows a top view of a bow adornment 250. The adornment shows four curved legs 255 which follow the contour of a cover base 260 and each terminate connected to a raised bow element 270. The bow element 270 may be removable from the cover base 260 for use as an accessory or jewelry. A pin (not shown) which friction fits into a pin guide (not shown) may be used to hold the bow in place. A series of one or more protrusions and indentations interposed on the bottom of said bow element 270 and the top region 262 of the base cover 260 may be used to align the bow when it is fitted on the base cover 260.

Figure 10:
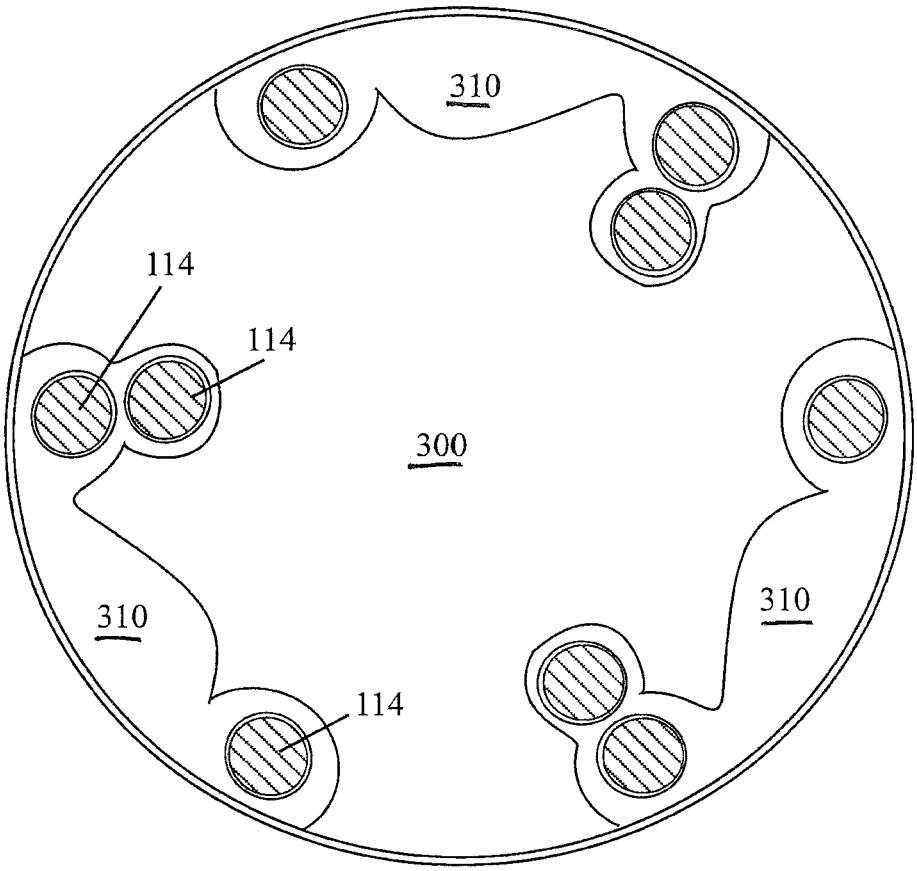
FIG. 10 shows a top view of an exemplary implementation of a three dimensional element to fit over a cover base.

FIG. 10 shows a cover base 300 with a plurality of medallion covers 310 attached. Said medallion covers 310 are shown supporting medium group three dimensional elements (MG3DE) 114 may be permanently or removable affixed with adhesives, welds, latches—catches, friction fit and optional pins and guides as described in reference to FIGS. 1-3 and 6-8.

Figure 11:
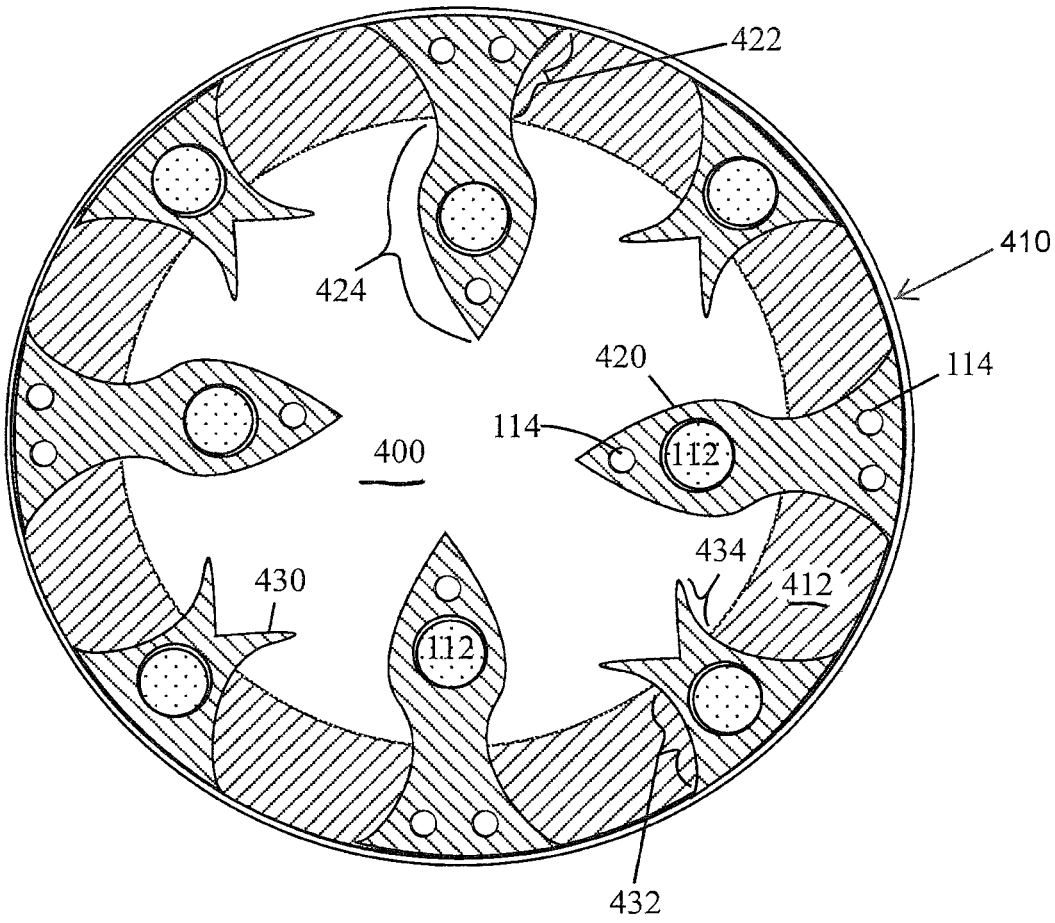
FIG. 11 shows an exemplary implementation of a top view of an exemplary implementation of a three dimensional element to fit over a cover base.

FIG. 11 shows a cover base 400 with the crown cover 410. A crown cover 410 is shown fitted around the cover base 400. The cover crown 410 in this implementation has a circular band 412 generally circumnavigating the larger diameter portion of the cover base 400 and of a size and shape to generally fit around at least a portion of said cover base 400. In some aspects long projections 420 have a first end 422 formed as part of, or affixed to, the band 412 and an unattached second end 424 extending generally upward from said first end. The generally upward extension may follow the curvature of the cover base 400 or it may be disparate from said cover base. In some aspects short projections 430 have a first end 432 formed as part of, or affixed to, the band 412 and an unattached second end 434 extending generally upward from said first end. The generally upward extension may follow the curvature of the cover base 400 or it may be disparate from said cover base. Short projections and long projections may have homogeneous curvatures and all tend to follow the curvature of the cover base. Short projections and long projections may have heterogeneous curvatures and each may have a different orientation relative to the cover base. In some instances a projection (long and/or short) or a group of projections may follow said curvature and in other aspects one or more of said projections (long and/or short) may either follow the curvature less closely or not art all. In some exemplary implementations at least one of LG3DE 112, medium group three dimensional elements (MG3DE) 114, I3DE 32 and SAE 36 are affixed to one or more of said projections.

Figure 12:
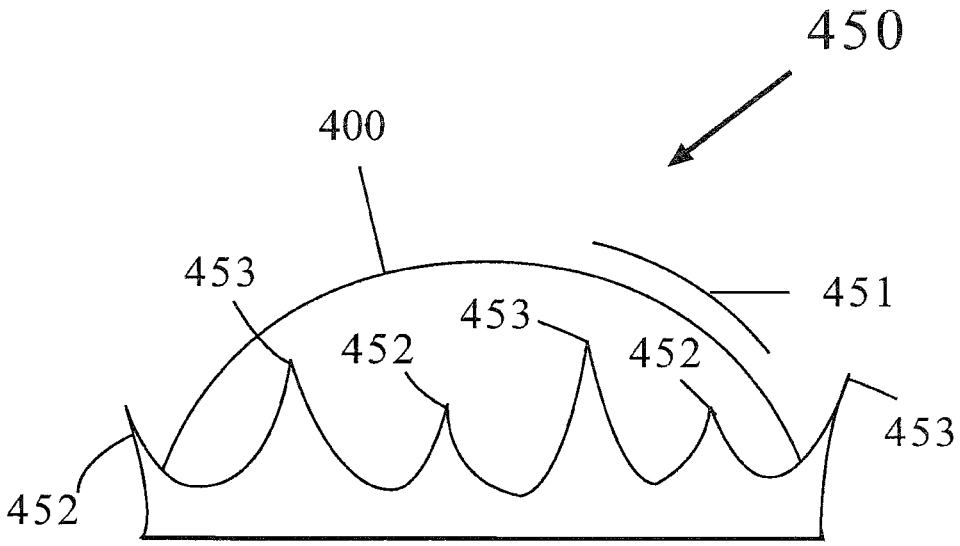
FIG. 12 shows an exemplary implementation of a cover on a cover base.

In some instances projections (long and/or short) may be skewed away from said curvature. Cover crown 450 shown in FIG. 12 has a radius of curvature 451. There are short projections 452 and long projections 453 and, some of the short projections follow the curvature and some of the short projections skew away from the radius of curvature 451. Some of the long projections follow the curvature and some of the long projections skew away from the radius of curvature 451.

Figure 13:
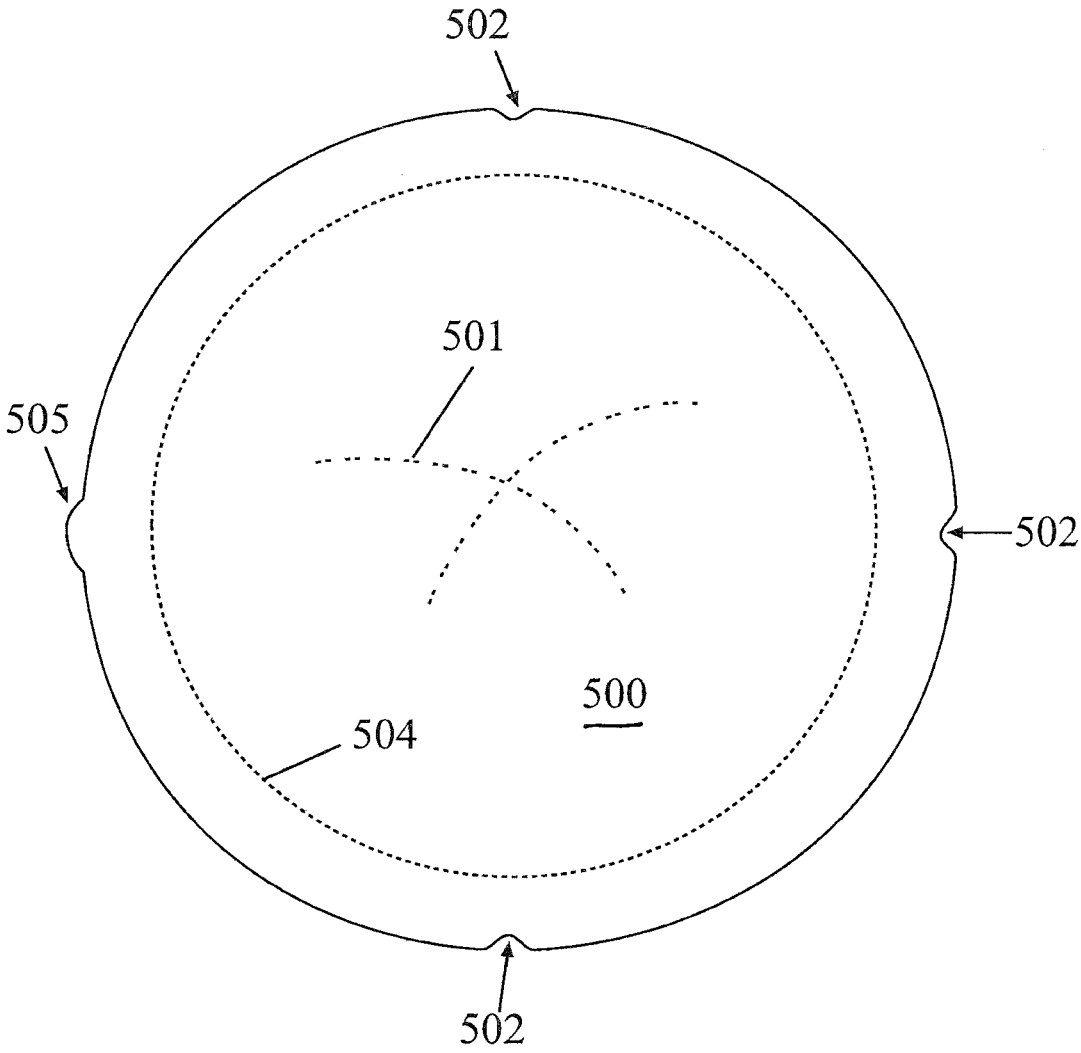
FIG. 13 shows an exemplary implementation of a cover base onto which a three dimensional element fits.

Shown in the exemplary implementation of FIG. 13 a cover base 500 with a radiuses surface 501 provides one or more undulations or indentations 502 around the periphery 504 of the cover base. A band or cover crown with an internal annular wall structure matching such indentations or undulations may be pressure fit onto such a mounting system. The inner side of such an annular wall which interfaces with the cover base 500 may be lined with a material to reduce the potential for scratching the cover base should the band or cover crown be removable. An alignment guide 505 may also be provides to provide an orientation for such a band or crown cover around the 360 degrees of a cover base.

Figure 14:
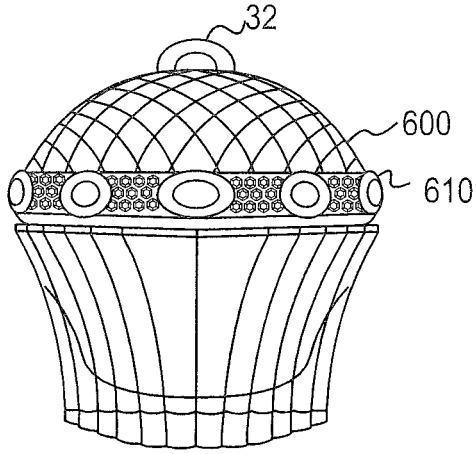
FIGS. 14-16 show exemplary implementations of a common cover base supporting different three dimensional elements.
Figure 15:
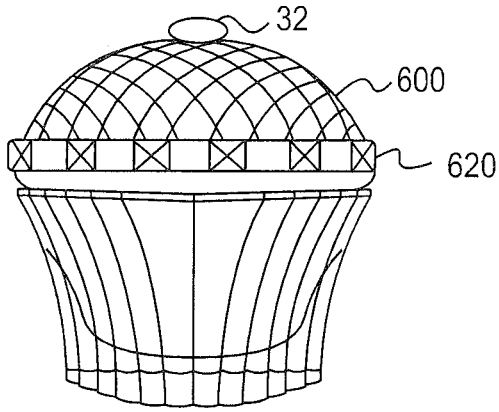
Figure 16:
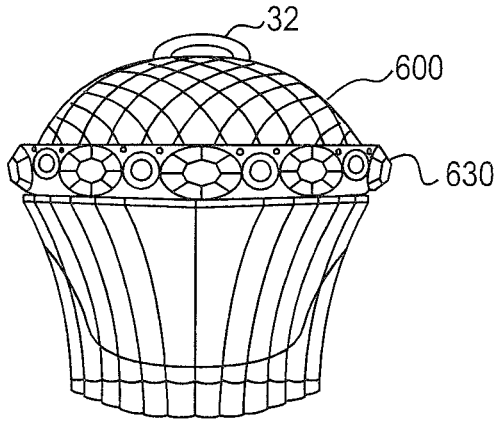

FIGS. 14-16 show the versatility of a common support base 600 wherein it retains or supports a variety of bands or cover crowns (which also may be described as three dimensional design covers). A first cover crown 610 with adornments may be interchanged with a second cover crown 620 with adornments which my be interchanged with a third cover crown 630 with adornments. Moreover I3DEs 32 at the top of the cover base (for example) may be interchanged.

While the method and agent have been described in terms of what are presently considered to be the most practical and preferred implementations, it is to be understood that the disclosure need not be limited to the disclosed implementations. It is intended to cover various modifications and similar arrangements included within the spirit and scope of the claims, the scope of which should be accorded the broadest interpretation so as to encompass all such modifications and similar structures. The present disclosure includes any and all implementations of the following claims.

It should also be understood that a variety of changes may be made without departing from the essence of the disclosure. Such changes are also implicitly included in the description. They still fall within the scope of this disclosure. It should be understood that this disclosure is intended to yield a patent covering numerous aspects of the disclosure both independently and as an overall system and in both method and apparatus modes.

Further, each of the various elements of the disclosure and claims may also be achieved in a variety of manners. This disclosure should be understood to encompass each such variation, be it a variation of an implementation of any apparatus implementation, a method or process implementation, or even merely a variation of any element of these.

Particularly, it should be understood that as the disclosure relates to elements of the disclosure, the words for each element may be expressed by equivalent apparatus terms or method terms—even if only the function or result is the same.

Such equivalent, broader, or even more generic terms should be considered to be encompassed in the description of each element or action. Such terms can be substituted where desired to make explicit the implicitly broad coverage to which this disclosure is entitled.

It should be understood that all actions may be expressed as a means for taking that action or as an element which causes that action.

Similarly, each physical element disclosed should be understood to encompass a disclosure of the action which that physical element facilitates.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in at least one of a standard technical dictionary recognized by artisans and the Random House Webster's Unabridged Dictionary, latest edition are hereby incorporated by reference.

Finally, all referenced listed in the Information Disclosure Statement or other information statement filed with the application are hereby appended and hereby incorporated by reference; however, as to each of the above, to the extent that such information or statements incorporated by reference might be considered inconsistent with the patenting of this/these disclosure(s), such statements are expressly not to be considered as made by the applicant(s).

In this regard it should be understood that for practical reasons and so as to avoid adding potentially hundreds of claims, the applicant has presented claims with initial dependencies only.

Support should be understood to exist to the degree required under new matter laws—including but not limited to United States Patent Law 35 USC 132 or other such laws—to permit the addition of any of the various dependencies or other elements presented under one independent claim or concept as dependencies or elements under any other independent claim or concept.

To the extent that insubstantial substitutes are made, to the extent that the applicant did not in fact draft any claim so as to literally encompass any particular implementation, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative implementations.

Further, the use of the transitional phrase "comprising" is used to maintain the "open-end" claims herein, according to traditional claim interpretation. Thus, unless the context requires otherwise, it should be understood that the term "compromise" or variations such as "comprises" or "comprising", are intended to imply the inclusion of a stated element or step or group of elements or steps but not the exclusion of any other element or step or group of elements or steps.

Such terms should be interpreted in their most expansive forms so as to afford the applicant the broadest coverage legally permissible.

The invention claimed is:

1. A cover display comprising:

a generally dome shaped cover base with a radius of curvature and one or more frame catches positioned near the periphery of said cover base;

a crown cover with an annular wall;

one or more frame latches positioned on said annular wall which correspond to said frame catches wherein said latches are affixed to the annular wall of the crown cover;

at least one alignment guide means near the periphery of said cover base;

at least one alignment key means on the annular wall of said crown cover; and projections extending upward from said crown cover, and wherein said projections general follow the curvature of said dome shaped cover.

2. The cover display device of claim 1 wherein the crown cover includes a crown frame and it fits generally around the periphery of the dome shaped cover.

3. The cover display device of claim 1 wherein said latches and catches are joined.

4. The cover display of claim 1 wherein said latches are attached to said catches whereby said crown cover is affixed to said dome shaped cover.

5. The cover display of claim 1 wherein at least one projection does not generally follow the radius of curvature of said dome shaped cover.

6. A cover display compromising:

a generally dome shaped cover base with a radius of curvature and one or more frame catches positioned near the periphery of said cover base;

a crown cover with an annular wall;

one or more frame latches positioned on said annular wall which correspond to said frame catches;

at least on alignment guide means near the periphery of said cover base;

at least one alignment key means on the annular wall of said crown cover;

at least one adornment element is affixed to said dome shaped cover; and wherein said adornment element is one of LG3DE, MG3DE, I3DE and SAE.

7. The cover display of claim 1 further comprising at least one adornment element is affixed to one or more projections.

8. The cover display of claim 7 wherein said adornment element is one of LG3DE, MG3DE, I3DE and SAE.

9. The cover display of claim 3 further comprising at least one alignment indent or protrusion formed on said annular wall corresponding to at least one indent or protrusion formed on said cover base, whereby the orientation of said crown cover may be selected relative to said crown base.

10. A cover display device comprising:

a generally dome shaped base with a radius of curvature and one or more indents or protrusions positioned near the periphery of said base;

a cover with an annular wall;

one or more indents or protrusions at said annular wall which correspond to the location of said corresponding protrusions or indents on said base; and at least one projection extending upward from said cover, wherein said projections generally follows the curvature of said dome shaped base.

11. The cover display device of claim 10 wherein the cover includes a frame and said indents or protrusions extended inward from an annular wall of said frame.

12. The cover display of claim 10 wherein said indents and protrusions are fitted with a friction fit to said dome shaped base.

13. The cover display of claim 12 further comprising at least a section of complaint material is affixed to said annular wall.

14. The cover display of claim 10 wherein at least one projection does not generally follow the radius of curvature of said dome shaped base.

15. The cover display of claim 10 further comprising at least one adornment element is affixed to said dome shaped base.

16. The cover display of claim 10 further comprising at least one adornment element is affixed to one or more projections.

17. A display device comprising:

a base with a generally flat bottom and a hemispherical top;

one or more indents or protrusions positioned on the base near the periphery of said base;

one or more catches positioned near the periphery of said base;

a three dimensional design cover with an annular wall;

one or more latches positioned on said annular wall which correspond to said catches;

one or more indents or protrusions at said annular wall which correspond to the location of said corresponding protrusions or indents on said base; and at least one protrusion extending upward from said three dimensional design cover, wherein said projections general follow the curvature of said dome shaped cover.

18. The display device of claim 17 wherein the three dimensional design cover is attached via a combination of latches, catches, protrusions and indents to said hemispherical top.

19. A display device comprising:

a base with a generally flat bottom and a hemispherical top;

one or more indents or protrusions positioned on the base near the periphery of said base;

one or more catches positioned near the periphery of said base;

a three dimensional design cover with an annular wall;

one or more latches positioned on said annular wall which correspond to said catches;

one or more indents or protrusions at said annular wall which correspond to the location of said corresponding protrusions or indents on said base; and adornment elements on both of the hemispherical top and at least one projection;

wherein said adornment element is one of LG3DE, MG3DE, I1DE and SAE.

20. The cover display of claim 19 further comprising formed in said flat bottom at least one of an extended neck and a central cavity.

21. The cover display device of claim 1 wherein the frame catches are generally semi-circular indents in the dome shaped cover base having a flat bottom and the frame latches are generally semi-circular protrusions on the crown cover dimensioned to fit into the frame catches and prevent rotation of the crown cover with respect to the dome shaped cover base.

* * * * *